US006657146B1

(12) United States Patent
Sutter

(10) Patent No.: US 6,657,146 B1
(45) Date of Patent: Dec. 2, 2003

(54) BUTTON BALL AND ALIGNMENT RIB

(75) Inventor: Donald Edward Sutter, Martinsville, IN (US)

(73) Assignee: Thomson Licensing, S.A., Boulogne-Billancourt (FR)

( * ) Notice: Subject to any disclaimer, the term of this patent is extended or adjusted under 35 U.S.C. 154(b) by 0 days.

(21) Appl. No.: 09/713,276

(22) Filed: Nov. 15, 2000

Related U.S. Application Data

(60) Provisional application No. 60/192,718, filed on Mar. 28, 2000.

(51) Int. Cl.[7] ..... H01H 3/12
(52) U.S. Cl. ..... 200/341; 400/490
(58) Field of Search ..... 200/341; 24/458; 403/353; 400/490

(56) References Cited

U.S. PATENT DOCUMENTS

| | | | | |
|---|---|---|---|---|
| 3,900,712 A | 8/1975 | Fukao | 200/307 |
| 3,930,083 A | 12/1975 | Pinkham | 428/67 |
| 4,084,071 A | 4/1978 | Smith | 200/5 A |
| 4,771,143 A | 9/1988 | Hoffman | 200/159 |
| 4,876,415 A | 10/1989 | Clancy | |
| 5,494,363 A | 2/1996 | Hochgesang | 400/495 |
| 5,574,446 A | 11/1996 | Dittrich et al. | 341/22 |
| 5,668,358 A | 9/1997 | Wolf et al. | 200/5 A |
| 5,710,398 A | 1/1998 | Hassler et al. | 200/5 A |

FOREIGN PATENT DOCUMENTS

| | | |
|---|---|---|
| DE | 8401137 | 3/1984 |
| DE | 4337553 | 5/1995 |
| DE | 19736396 | 3/1998 |

OTHER PUBLICATIONS

Search Report for German Appln. No. 10112210.1 dated Apr. 5, 2002.

*Primary Examiner*—P. Austin Bradley
*Assistant Examiner*—Nhung Nguyen
(74) *Attorney, Agent, or Firm*—Joseph S. Tripoli; Robert D. Shedd; Reitseng Lin

(57) ABSTRACT

A button ball and alignment rib formed to a bezel mates with an aperture on a floating button cluster to align and secure the floating button cluster such that the buttons of the floating button cluster are aligned with their corresponding apertures formed in the bezel. The alignment rib has a tapered rib disposed upon it and upon the tapered rib is formed a semi-spherical ball reinforced by an enlarged post that is formed from the bezel to the semi-spherical ball. A plurality of apertures are formed in the floating button cluster, one of which receives the semi-spherical ball and retains it once it has passed through the aperture.

10 Claims, 2 Drawing Sheets

BUTTON BALL AND ALIGNMENT RIB

Benefit is claimed from U.S. provisional patent application 60/192,718 filed Mar. 28, 2000.

BACKGROUND OF THE INVENTION

1. Field of the Invention

The present invention relates generally to pushbutton selector switches. More specifically, the present invention relates to a ball and alignment rib with a retainer for mounting floating button clusters.

2. Description of the Background Art

Assemblies wherein button clusters are mounted to bezels have seen increasing utility and are often found in devices such as computer interfaces, joysticks, automotive mirror controls and the like. One application for bezel mounted buttons is in telecommunication devices such as televisions and associated peripherals (i.e., control boxes, remotes, video players and the like). These bezel mounted button clusters allow a user to select responses to menu prompts in a quick and efficient manner using a minimal user interface.

However, bezel mounted floating button clusters require careful and meticulous design in order to enable the actuator of the bezel mounted floating button cluster to close an appropriate contact or switch. Often, the motion enabling device, or hinge, allows some translational motion of the actuator that may allow the actuator to miss the switch, or become "hung-up", i.e., stuck, upon the switch or other surrounding structure. Additionally, some bezel mounted floating button clusters have a "mushy" or indistinct feel that causes the user to hesitate during selection and rely on a display to confirm that the desired selection was made.

Therefore, there is a need in the art for a bezel mounted floating button cluster that can be easily aligned with its bezel providing good positional accuracy in relation to the bezel and the button. Furthermore, such bezel mounted floating button clusters should have an ease of assembly, and allow the builders or assemblers to assemble the button cluster to the bezel without fear that the button cluster will come away from the bezel or become misaligned with the bezel during assembly.

SUMMARY OF THE INVENTION

The disadvantages associated with the prior art are overcome by the present invention of a ball and alignment rib for mounting bezel mounted floating button clusters. Specifically, the alignment rib for the bezel mounted floating button cluster of the present invention comprises a carrier rib, upon which is disposed a tapered rib, upon which is mounted a semi-spherical ball reinforced by an enlarged post. The alignment rib mates to an aperture in the bezel mounted floating button cluster, the aperture is formed such that the semi-spherical ball passes through the formed aperture causing a retention rib to flex slightly into a vertical slot which is disposed directly next to the tapered slot of the bezel mounted floating button cluster. After the tapered hole has received this semi-spherical ball, the retention rib elastically forms to its previous position, and forms around the bezel mounted carrier rib, thus aligning and securing the bezel mounted floating button cluster.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
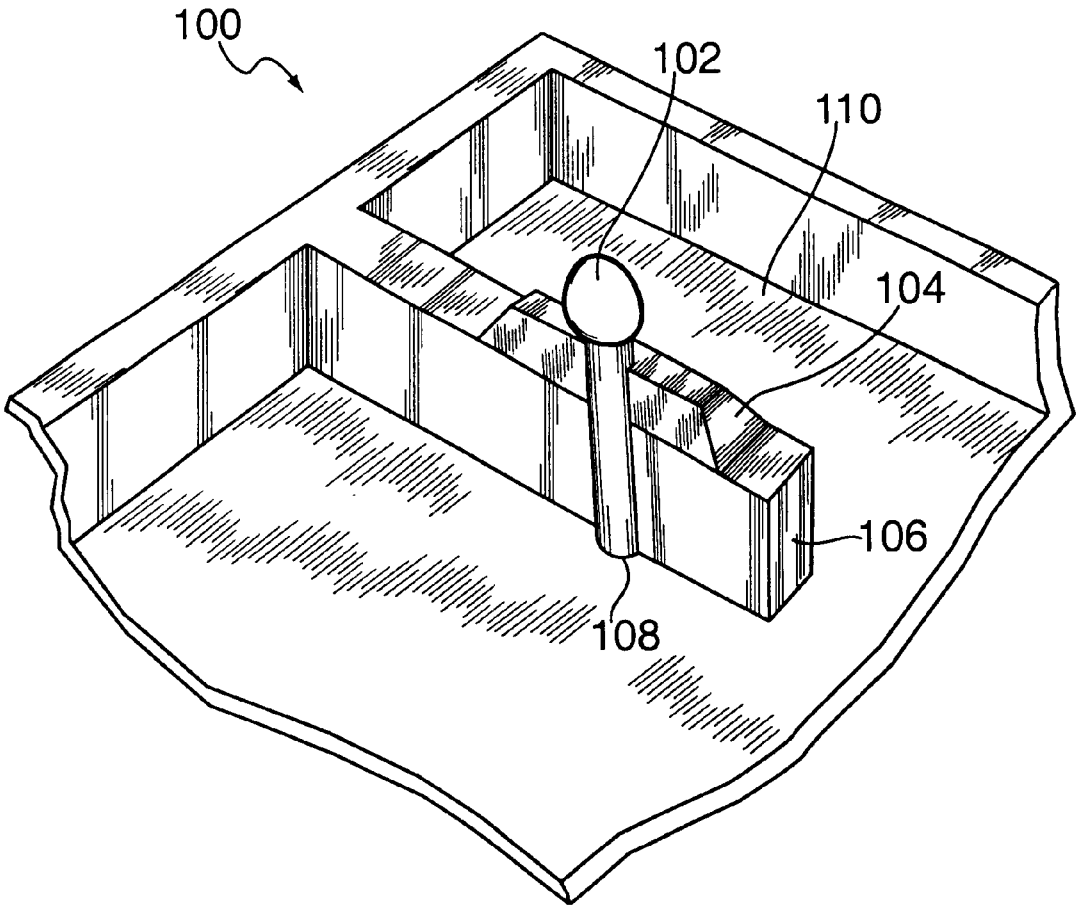
FIG. 1 depicts a detailed view of an embodiment of a carrier rib assembly formed to the inside of a bezel of the present invention.

Specifically, FIG. 1 depicts the ball and alignment rib 100 having a semi-spherical ball 102 connected to a tapered rib 104, which is disposed on a carrier rib 106 and reinforced by an enlarged post 108.

Figure 2:
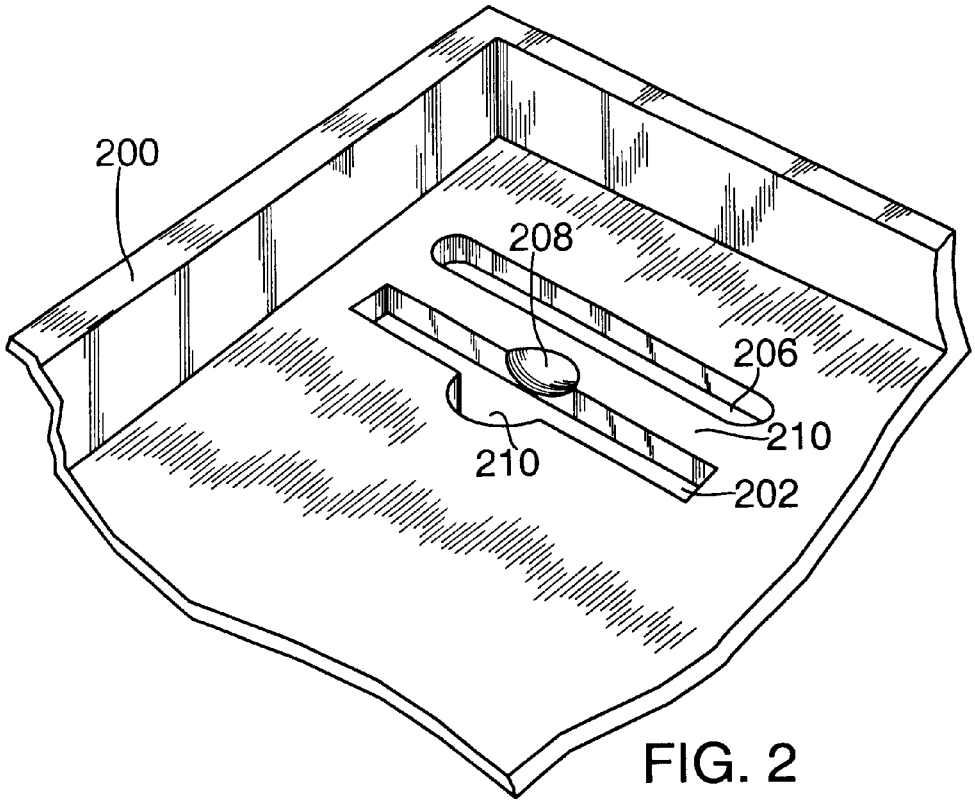
FIG. 2 depicts a detailed view of an embodiment of a bezel mounted floating button cluster of the present invention.

The entire unit is preferably fabricated from a moldable plastic (e.g., polycarbonate), and the unit is also preferably molded into the bezel. The semi-spherical ball 102 is formed such that a flat is formed on one side which would form a hemisphere along a longitudinal polar axis if the ball 102 had been formed spherically. The semi-spherical ball 102 acts as a retaining tab when mated with the floating button cluster 200 as seen in FIG. 2. The semi-spherical ball 102 is formed upon a tapered rib 104. The tapered rib 104 is comprised of a formed unit having a length, width and a respective height. The tapered rib 104 is formed so that the widest portion is the base which is formed on top of the carrier rib 106. The tapered rib 104 projects from the carrier rib 106 and tapers in width as the height increases.

The carrier rib 106 is formed as part of the inside surface of the bezel 110. The carrier rib 106, like the taper rib 104, has a respective length, width and height and projects outward from the bezel 110. Both the taper rib 104 and the semi-spherical ball 102 are formed on top of the carrier rib 106.

An enlarged post 108 is formed as a projected feature on the carrier rib 106 and tapered rib 104 terminating in the semi-spherical ball 102 and acting as a reinforcement to the semi-spherical ball 102. The enlarged post 108 is formed in the bezel 110 like the carrier rib 106 and projects upward in the vertical plane through both the carrier rib 106 and the tapered rib 104 to reach the semi-spherical ball 102.

In one embodiment, a set of specially-formed mating apertures is located in the floating button cluster 200; as can be seen in FIG. 2. The floating button cluster 200 has a set of buttons (not shown) which project through and are actuated through corresponding apertures (not shown) in the bezel 110.

A tapered aperture 202 is formed in the floating button cluster 200. The dimensions of the tapered aperture 202 correspond to the dimensions of the tapered rib 104. The tapered aperture 202 is formed to allow the mating of tapered rib 104 without interference.

A retention rib 204 is formed in the floating button cluster 200 next to and parallel to the tapered aperture 202. The retaining rib 204 is formed of a material and of dimensions such that it will not succumb to plastic deformation due to flexing or minor deflection and shall form back to its original shape after being stressed.

A vertical slot 206 is formed in the floating button cluster 200 parallel and next to the retention rib 204. This aperture 206 allows retention rib 204 to be non-plastically deformed when a force is applied to retention rib 204.

A force applied to retention rib 204 through the tapered aperture 202 is spread along the length of retention rib 204 along the inside of the vertical slot aperture 206. Spreading the stress to retention rib 204 prevents a stress fracture and allows the natural resiliency of the material of restraining rib 204 to elastically flex back to its original position after the force has been released.

Another feature of the floating button cluster 200 is the spherical seat 208 which is formed in the retention rib 204. The seat 208 is formed as a depression in the material of retention rib 204. The spherical seat 208 provides for better retention of the semi-spherical ball 102 after the bezel 110 and the floating button cluster 200 are mated.

Another feature of the floating button cluster 200 is the semi-spherical tapered aperture 210. The semi-spherical tapered aperture 210 is formed through the entire plane of the material of the floating button cluster 200. The widest portion of the aperture is formed on the side of the floating button cluster 200 that first comes in contact with the semi-spherical ball 102. The perimeter of the aperture of the semi-spherical taper aperture 210 shrinks as the aperture progresses through the plane of material of the floating button cluster 200. The semi-spherical tapered aperture 210 is formed in the tapered aperture 202 at a point to correspond with that of the semi-spherical ball 102 as mounted on the tapered rib 104. The semi-spherical tapered aperture 210 allows the semi-spherical ball 102 to pass through, however, the dimensions of the semi-spherical tapered aperture are slightly smaller than that of the semi-spherical ball 102.

Figure 3:
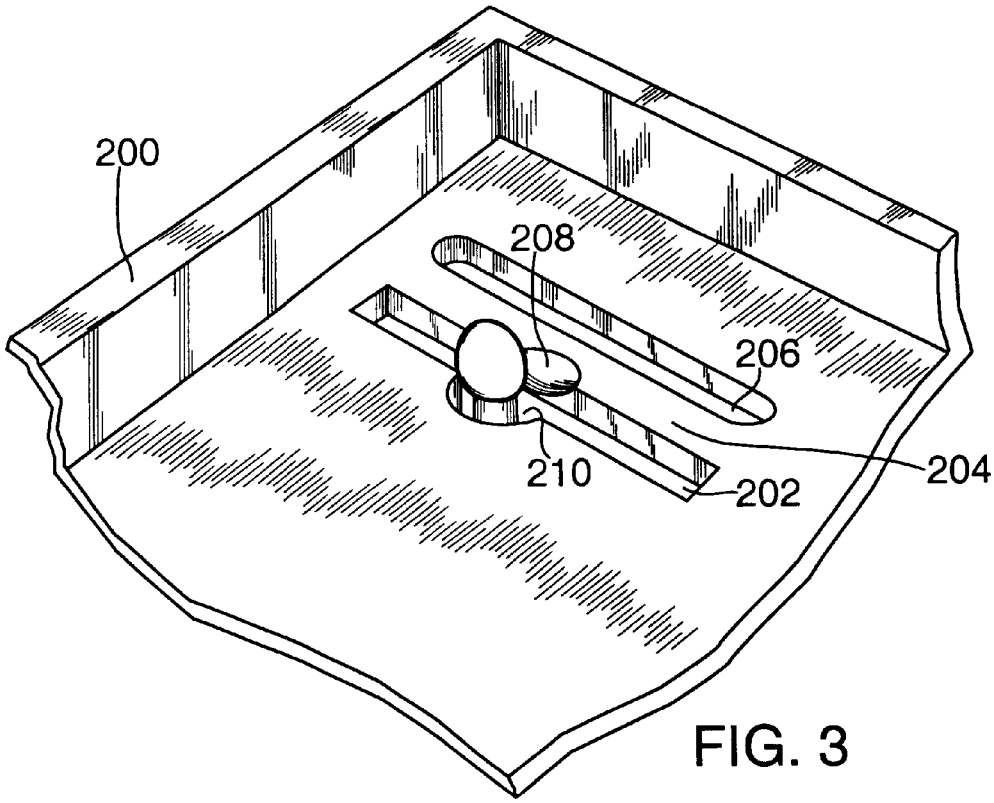
FIG. 3 depicts the assembly of FIG. 2 as the two parts are being mated.

When assembled, as can be seen in FIG. 3, the semi-spherical ball 102 intersects the semi-spherical tapered aperture 210 and forces the retention rib 204 back into the vertical slot aperture 206. As the semi-spherical ball 102 passes through the semi-spherical tapered aperture 210, the tapered aperture 202 helps to align the tapered rib 104 correctly with the bezel 110. Once the semi-spherical ball 102 has passed completely through the semi-spherical tapered aperture 210, retention rib 204 springs back to its original position mating tapered aperture 202 with tapered rib 104. Carrier rib 106 rests against the outside of bezel 200 and prevents further penetration into tapered aperture 202 by tapered rib 104.

As the embodiments that incorporate the teachings of the present invention have been shown and described in detail, those skilled in the art can readily devise many other varied embodiments that still incorporate these teachings without departing from the spirit of the invention.

What is claimed is:

1. Apparatus for retaining at least one button comprising:

(a) a carrier rib;

(b) a tapered rib disposed upon said carrier rib;

(c) a semi-spherical ball disposed upon said tapered rib;

(d) a post molded through said tapered rib having two respective ends, connecting the semi-spherical ball and the bezel;

(e) a button mounting bracket;

(f) a plurality of apertures disposed in said button mounting bracket to mate with said semi-spherical ball and said tapered rib; and (g) at least one retention rib disposed in said button mounting bracket to retain said semi-spherical ball.

2. The apparatus of claim 1 wherein the post is disposed perpendicular and vertical to the carrier rib and the tapered rib and terminates in the spherical ball.

3. The apparatus of claim 1 wherein the button mounting bracket contains at least one semi-spherical aperture.

4. The apparatus of claim 1 wherein said retention ribs are parallel to said semi-spherical aperture.

5. The apparatus of claim 1 further comprising a tapered aperture disposed in said semi-spherical aperture.

6. Apparatus for retaining at least one button cluster comprising:

(a) two molded mating assemblies wherein said first molded mating assembly comprises;

(b) a carrier rib formed to a bezel assembly upon which is disposed;

(c) a tapered rib formed upon said carrier rib;

(d) a spherical ball formed upon said tapered rib;

(e) an enlarged post extending from the bezel through the carrier rib through the tapered rib and terminating at the spherical ball;

(f) a second molded assembly comprising a rectangular aperture, said aperture being disposed through said assembly;

(g) a retention rib located parallel to said rectangular aperture;

(h) a semi-spherical aperture located inside said rectangular aperture; and (i) a vertical slot located parallel to said retention rib.

7. The apparatus of claim 6 further comprising a spherical seat disposed in said spherical aperture.

8. The apparatus of claim 6 wherein the tapered slot is designed to mate with the tapered rib of said first molded assembly.

9. The apparatus of claim 6 wherein the tapered slot is located close enough to the retention rib such that the retention rib may flex into the aperture space provided by the tapered slot.

10. The apparatus of claim 6 wherein the spherical aperture disposed in the rectangular aperture is a tapered aperture.

* * * * *